US007204719B2

(12) United States Patent
Kikuchi

(10) Patent No.: US 7,204,719 B2
(45) Date of Patent: Apr. 17, 2007

(54) CONNECTOR FOR SOLDERLESS CONNECTION AND PLUG CONNECTED TO THE CONNECTOR

(75) Inventor: Eiji Kikuchi, Tokyo (JP)

(73) Assignee: Nippon Dics Co., Ltd., Tokyo (JP)

( * ) Notice: Subject to any disclaimer, the term of this patent is extended or adjusted under 35 U.S.C. 154(b) by 0 days.

(21) Appl. No.: 11/460,740

(22) Filed: Jul. 28, 2006

(65) Prior Publication Data

US 2007/0026730 A1 Feb. 1, 2007

(30) Foreign Application Priority Data

Jul. 29, 2005 (JP) ..... 2005-220693

(51) Int. Cl.
*H01R 24/00* (2006.01)

(52) U.S. Cl. ..... 439/631; 439/638

(58) Field of Classification Search ..... 439/552, 439/61, 631, 634, 736
See application file for complete search history.

(56) References Cited

U.S. PATENT DOCUMENTS 4,087,668 A * 5/1978 Nakanishi et al. ..... 200/254
4,400,049 A * 8/1983 Schuck ..... 439/631
4,453,792 A * 6/1984 Bright et al. ..... 439/251
4,597,619 A * 7/1986 Reimer ..... 439/260
4,660,920 A * 4/1987 Shibano ..... 439/631
4,878,862 A * 11/1989 Wise ..... 439/787
4,981,449 A * 1/1991 Buchter ..... 439/724
4,983,132 A * 1/1991 Weidler ..... 439/786
5,024,627 A * 6/1991 Bennett et al. ..... 439/631
5,122,072 A * 6/1992 Arn et al. ..... 439/210
5,746,620 A * 5/1998 Clark ..... 439/404
6,796,822 B2 * 9/2004 Sato et al. ..... 439/260

* cited by examiner

*Primary Examiner*—Michael C. Zarroli
(74) *Attorney, Agent, or Firm*—Westerman, Hattori, Daniels & Adrian, LLP.

(57) ABSTRACT

A connector including a plurality of terminal wires forming gently-sloping hills in a longitudinal direction and having curved front and rear opposite end portions and wire retaining bodies each of which has substantially the same length as the wires to partially cover front half sides and rear half sides of one faces of the wires without contact and to restrain and retain intermediate portions of the wires. The two wire retaining bodies are combined into combined wire retaining bodies in such a manner that the curved opposite end portions of the retained wires face each to form terminal pinching portions. The combined wire retaining bodies are housed in a cylindrical connector casing having front and rear opposite open ends. The front and rear terminal pinching portions of the retaining bodies face the front and rear open end portions of the connector casing.

4 Claims, 8 Drawing Sheets

CONNECTOR FOR SOLDERLESS CONNECTION AND PLUG CONNECTED TO THE CONNECTOR

BACKGROUND OF THE INVENTION

1. Field of the Invention

The present invention relates to a connector of a type to be plugged in a board so that wiring of an external device or a circuit can be connected without soldering to a plurality of terminals of circuits and electronic elements printed on the board, a plug to be plugged in this connector for connection of the external device or the circuit, and a manufacturing method of the connector.

2. Description of the Related Art

Conventionally, a connector for connection without soldering by employing a structure to be plugged in a circuit board and connected to a plurality of terminals arranged in a row and printed on the board is known from Patent Document 1 and the like.

However, because the structure of the connector of the type to be plugged in the board becomes considerably complicated, structures of metal molds become extremely complicated and, as a result, assembly becomes very troublesome. Therefore, this structure of the connector is susceptible to improvements in the cost of the metal molds and the cost of manufacturing.

[Patent Document 1] Japanese Patent No. 339839

SUMMARY OF THE INVENTION

Therefore, it is an object of the present invention to provide a connector of a type to be plugged in a board, a manufacturing method of the connector, and a plug to be plugged in the connector, significant improvements having been made in a cost of metal molds and a cost of manufacturing of the connector by simplifying structures of the metal molds and making it possible to assemble the connector on an automatic assembly line.

To achieve the above object, according to the present invention, there is provided a connector comprising a plurality of terminal wires forming gently-sloping hills in a longitudinal direction and having curved front and rear opposite end portions and wire retaining bodies each of which has substantially the same length as the wires to partially cover front half sides and rear half sides of one faces of the wires without contact and to restrain and retain intermediate portions of the wires, wherein the two wire retaining bodies are combined into combined wire retaining bodies in such a manner that the curved opposite end portions of the retained wires face each other to form terminal pinching portions, the combined wire retaining bodies are housed in a cylindrical connector casing having front and rear opposite open ends, and the front and rear terminal pinching portions of the retaining bodies face the front and rear open end portions of the connector casing.

In the invention, a plug receiving cylinder may be housed as a plug plug-in portion in one of the open portions of the connector casing.

The front and rear terminal pinching portions of the combined wire retaining bodies and disposed to face the openings at the opposite ends of the casing are connected to terminals arranged in a row on a board side and terminals arranged in a row on a plug side by plugging-in and pinching.

In the above connector of the invention, a cylindrical plug receiving cylinder on an inner face of which contacts to come in contact with grounding electrodes of the plug are formed is inserted into and attached to either one of the opening portions of the casing to thereby form the plug receiving cylinder side as a portion to be connected to the plug and the opening portion on the side not provided with the plug receiving cylinder as a portion to be connected to the board by plugging-in. The plug receiving cylinder is provided with support legs for inserting and fixing the cylinder into the casing.

On the other hand, according to the invention, there is provided a plug to be inserted into and connected to the plug receiving body side, the plug comprising:

a plug main body formed of a non-conductor of electricity such as plastic in a state in which respective conductors of the plurality of cables are led inside;

a plug-in cylinder portion provided to the plug main body and fitted into the plug receiving cylinder according to claim 2; and a terminal plate disposed in the plug-in cylinder portion and pinched by and connected to the terminal pinching portions disposed in the plug receiving cylinder, wherein the plurality of conductors led into the plug main body are connected to respective terminals of the terminal plate.

There is provided a manufacturing method of the connector of the invention having the above-described structure, the method including the steps of:

partially covering without contact front half portions and rear half portions of the other faces side of a plurality of terminal wires arranged parallel with wire retaining bodies each of which has substantially the same length as the wires while leaving the whole one face sides of the wires open and restraining and retaining intermediate portions of the wires with an intermediate portion of each retaining body;

forming the wires in a restrained and retained state so that the wires form gently-sloping hills in their longitudinal direction and have curved warped front and rear opposite ends;

combining the two wire retaining bodies formed in the above manner into combined retaining bodies in such a manner that the warped portions of the opposite ends of the wires retained by both the retaining bodies face each other to form terminal pinching portions; and housing and fixing the combined retaining bodies into a cylindrical connector casing having front and rear opposite open ends in such a manner that the front and rear terminal pinching portions of the combined retaining bodies face the front and rear open end portions of the casing.

EFFECTS OF THE INVENTION

In the present invention, the connector for connecting terminals to circuits or electronic elements on the board by plugging-in and without soldering comprises a plurality of terminal wires forming gently-sloping hills in a longitudinal direction and having curved front and rear opposite end portions and wire retaining bodies each of which has substantially the same length as the wires to partially cover front half sides and rear half sides of one faces of the wires without contact and to restrain and retain intermediate portions of the wires, wherein the two wire retaining bodies are combined into combined wire retaining bodies in such a manner that the curved opposite end portions of the retained wires face each other to form terminal pinching portions, the combined wire retaining bodies are housed in a cylindrical connector casing having front and rear opposite open ends, and the front and rear terminal pinching portions of the retaining bodies face the front and rear open end portions of the connector casing.

A plug to be connected to the connector of the invention comprises;

a plug main body formed of a non-conductor of electricity such as plastic in a state in which respective conductors of the plurality of cables are led inside;

a plug-in cylinder portion provided to the plug main body and fitted into the plug receiving cylinder according to claim 2; and a terminal plate disposed in the plug-in cylinder portion and pinched by and connected to the terminal pinching portions disposed in the plug receiving cylinder, wherein the plurality of conductors led into the plug main body are connected to respective terminals of the terminal plate.

Because the plug-in connector is formed as described above, it is possible to simplify structures of metal molds of the connector to achieve solderless connection. Because the connector can be assembled on the automatic assembly line, it is possible to obtain the connector of the type to be plugged in the board highly advantageous in the cost of the metal molds and the cost of manufacturing.

It is also possible to manufacture and provide the plug to be plugged in the connector easily and at low cost, because the plug has the simple structure.

FIG; 6 is a plan view of a connector plug-in portion formed on a circuit board, where terminals into which the connector of the invention is to be plugged are arranged.

Figure 4:
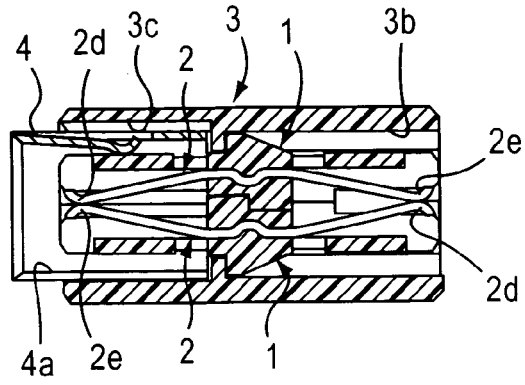
FIG. 4 is a vertical sectional side view of a completed state and showing the sequence of assembly of the connector of the present invention on the time series so as to explain the structure of the example of the connector
Figure 6:
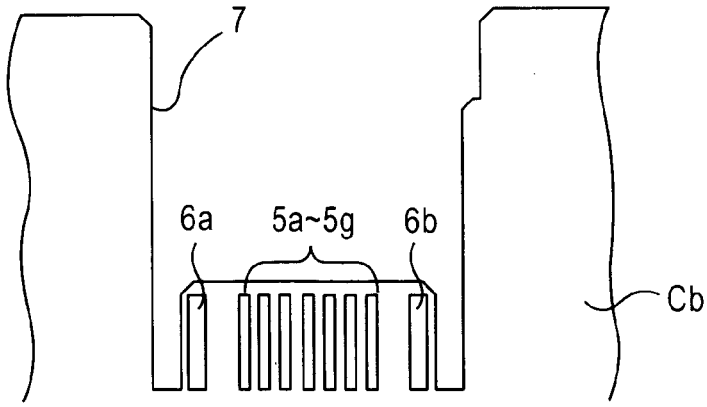
Figure 7:
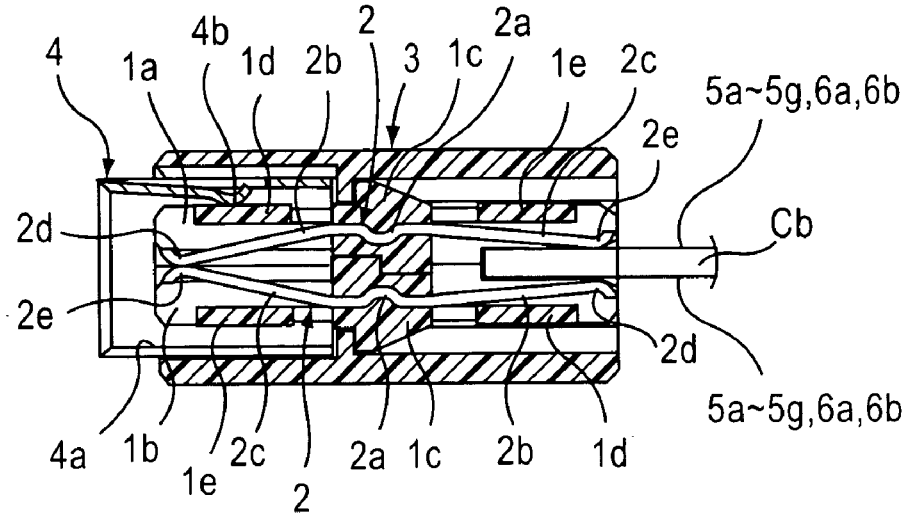

FIG. 7 is a side sectional view of a state in which the connector in FIG. 4 is plugged in the plug-in portion in FIG. 6.

Figure 5:
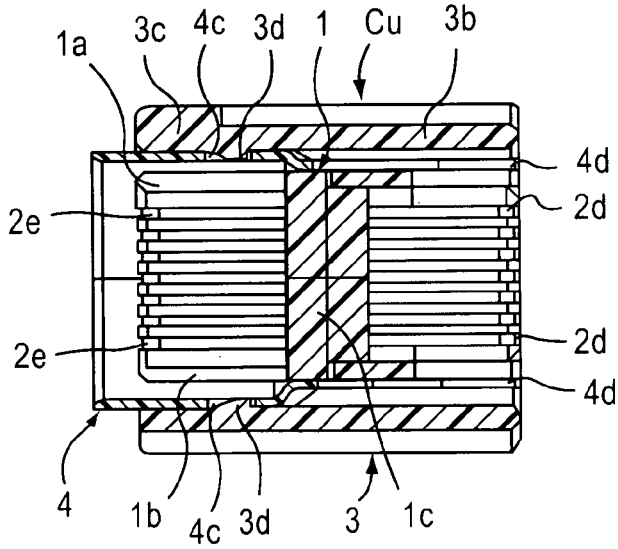
FIG. 5 is a plan sectional view of the connector in FIG. 4.
Figure 8:
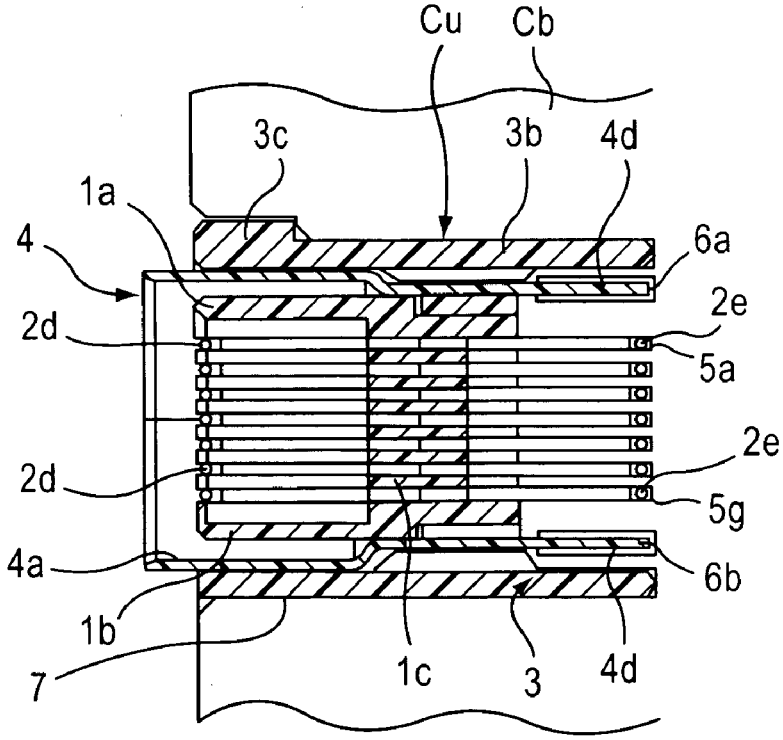

FIG. 8 is a plan sectional view of a state in which the connector in FIG. 5 is plugged in the plug-in portion in FIG. 6 (or a plan sectional view of FIG, 7).

Figure 9:
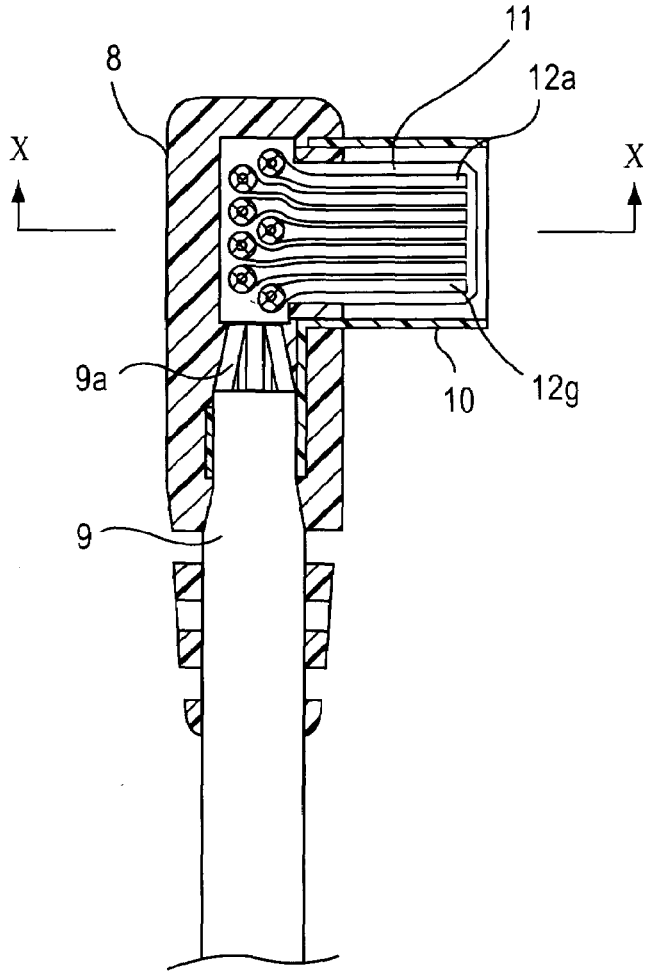

FIG. 9 is a side sectional view of a plug to be connected to the connectors in FIGS. 7 and 8.

Figure 10:
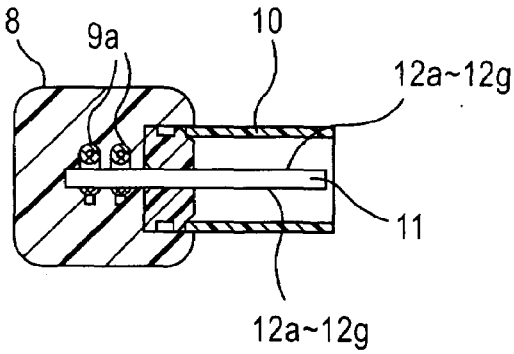

FIG. 10 is a view of the connector in FIG. 9 taken along a line X—X and in a direction of arrows.

Figure 11:
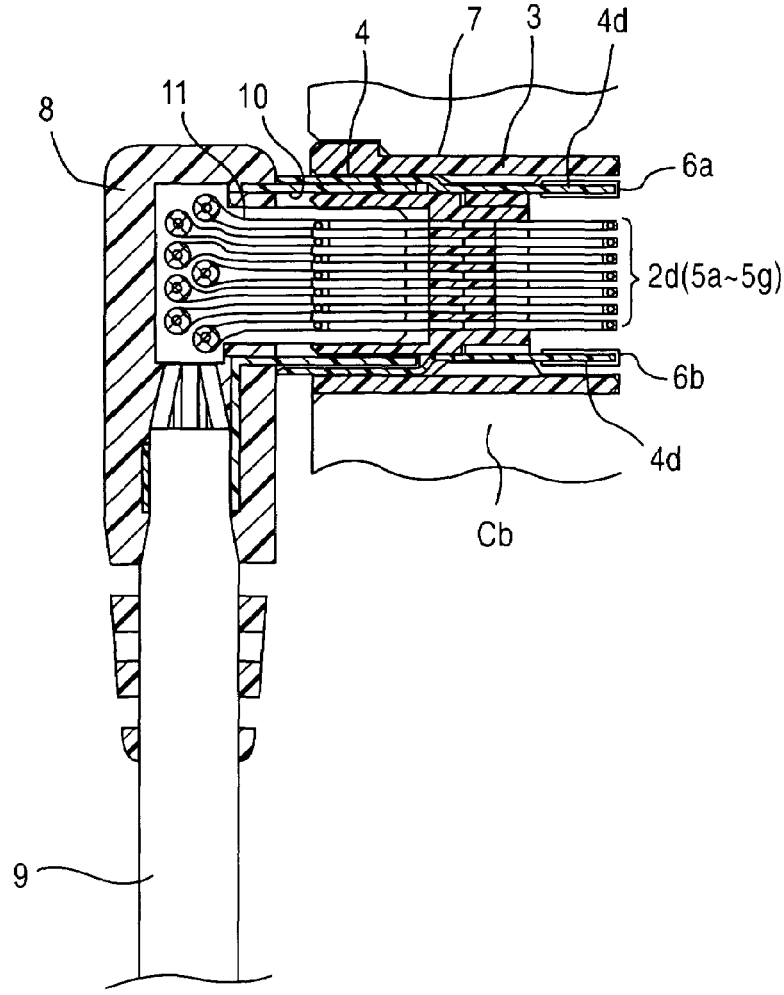

FIG. 11 is a sectional view of a state in which the plug in FIG. 10 is plugged in the connector in the state of FIG. 8.

Figure 12:
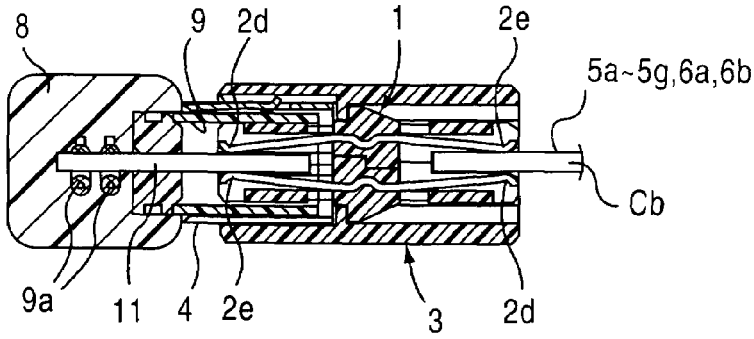

FIG. 12 is a sectional view of a state in which the plug in FIG. 9 is plugged in the connector in the state of FIG. 7.

Figure 13:
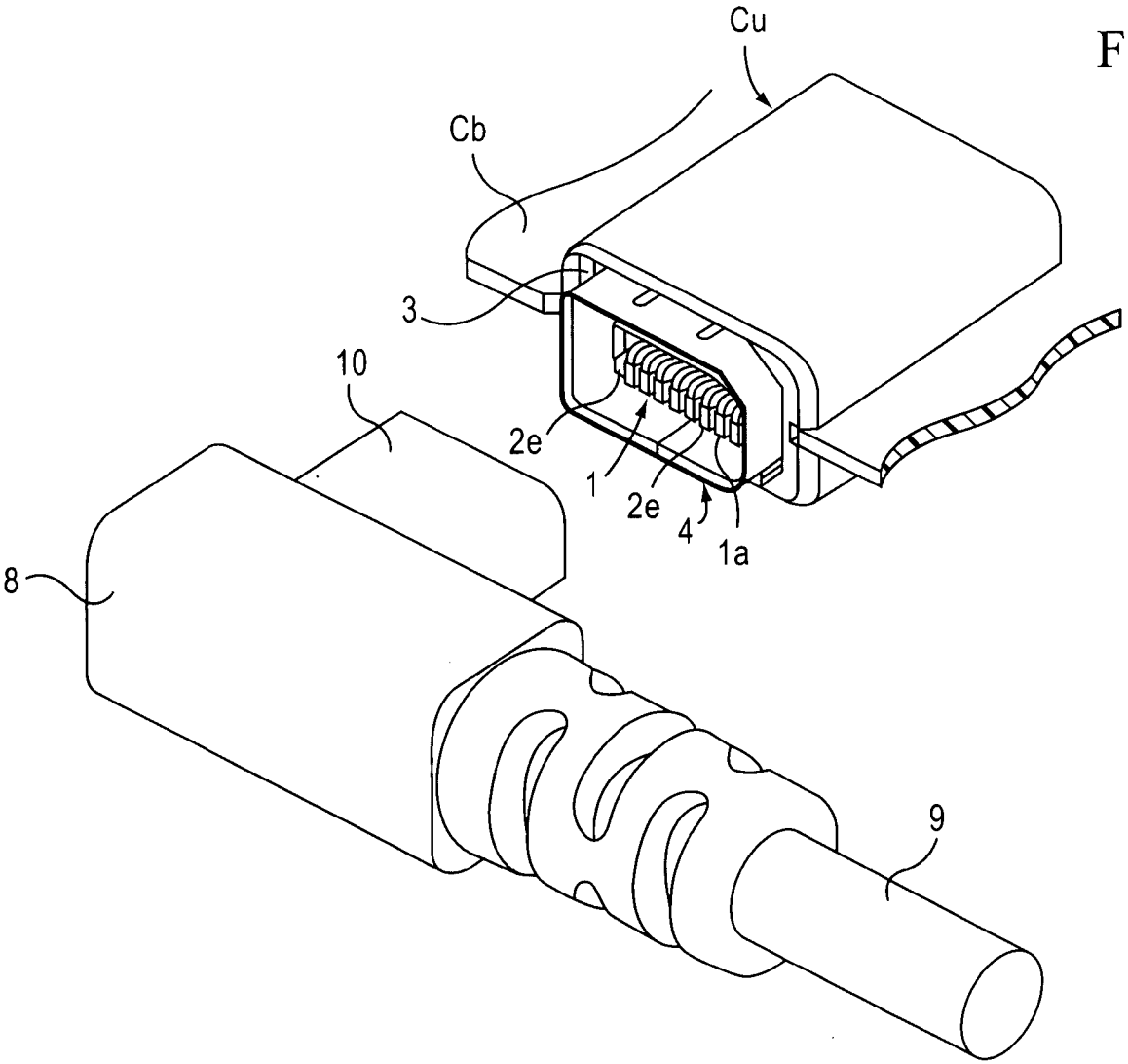

FIG. 13 is a perspective view of the plug and the connector explained in FIGS. 4 to 12 before plugging in of the plug.

Figure 1:
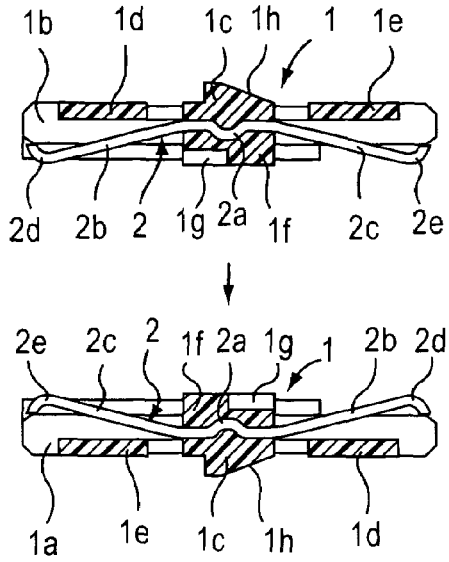
FIG. 1 is a vertical sectional side view of a first step and showing a sequence of assembly of a connector of the present invention on the time series so as to explain a structure of an example of the connector.
Figure 14:
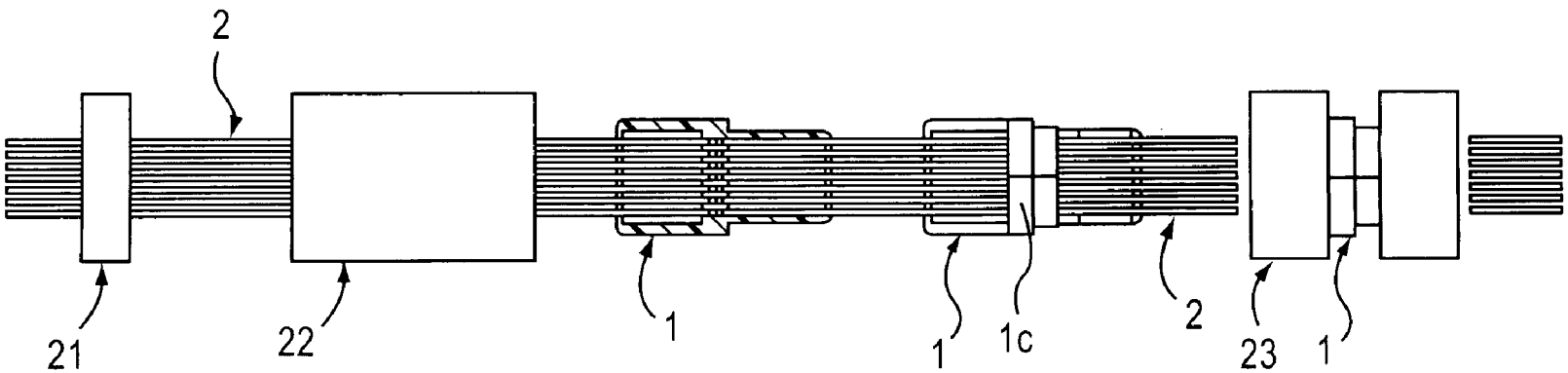

FIG. 14 is a schematic plan view for explaining a manufacturing step of parts of the connector in FIG. 1.

Figure 15:
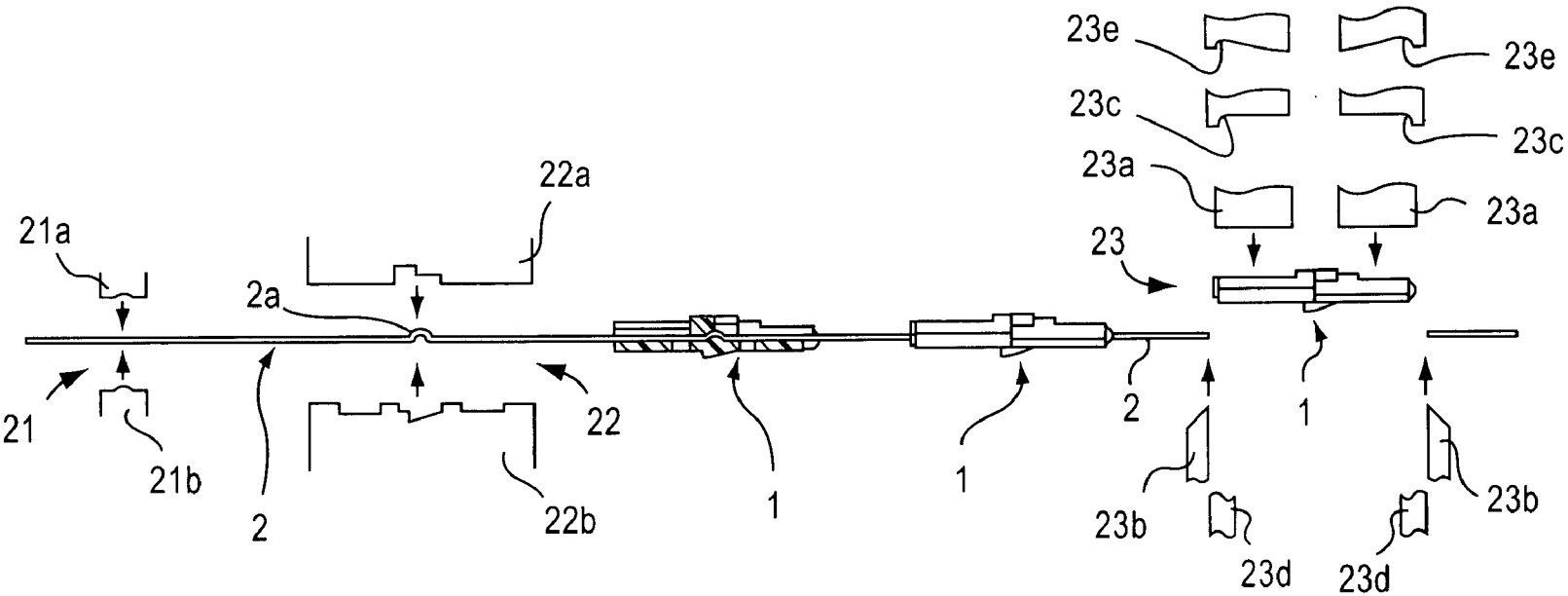

FIG. 15 is a front view of FIG. 14.

DETAILED DESCRIPTION OF PREFERRED EMBODIMENTS

Figure 2:
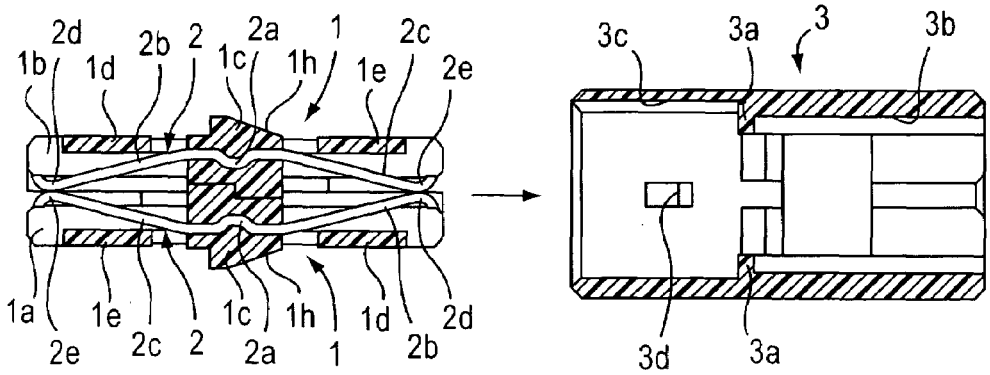
FIG. 2 is a vertical sectional side view of a second step and showing the sequence of assembly of the connector of the present invention on the time series so as to explain the structure of the example of the connector.
Figure 3:
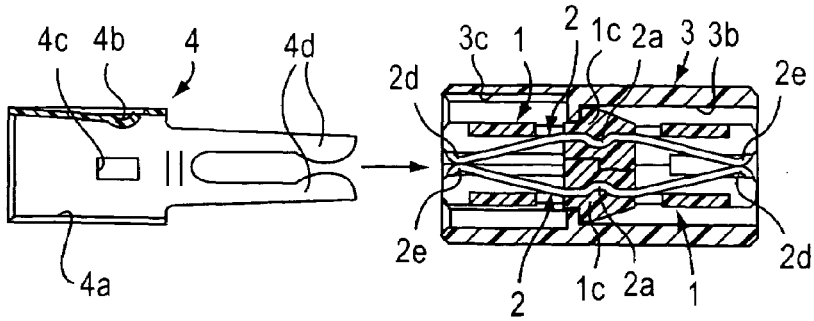
FIG. 3 is a vertical sectional side view of a third step and showing the sequence of assembly of the connector of the present invention on the time series so as to explain the structure of the example of the connector.

Next, embodiments of a connector and a plug of the present invention will be described with reference to the drawings. In the accompanying drawings, FIGS. 1 to 4 are vertical sectional side views of a sequence of assembly of the connector of the invention on the time series so as to explain a structure of an example of the connector, where FIG. 1 is a sectional view of a first step, FIG. 2 is a sectional view of a second step, FIG. 3 is a sectional view of a third step, and FIG. 4 is a sectional view of a completed state. FIG. 5 is a plan sectional view of the connector in FIG. 4. FIG. 6 is a plan view of a connector plug-in portion formed on a circuit board, where terminals into which the connector of the invention is to be plugged are arranged. FIG. 7 is a side sectional view of a state in which the connector in FIG. 4 is plugged in the plug-in portion in FIG. 6. FIG. 8 is a plan sectional view of a state in which the connector in FIG. 5 is plugged in the plug-in portion in FIG. 6 (or a plan sectional view of FIG. 7). FIG. 9 is a side sectional view of a plug to be connected to the connectors in FIGS. 7 and 8. FIG. 10 is a view of the plug in FIG. 9 taken along a line X—X and in a direction of arrows. FIG. 11 is a sectional view of a state in which the plug in FIG. 10 is plugged in the connector in the state of FIG. 8 FIG. 12 is a sectional view of a state in which the plug in FIG. 9 is plugged in the connector in the state of FIG. 7 FIG. 13 is a perspective view of the plug and the connector explained in FIGS. 4 to 12 before plugging in of the plugs FIG. 14 is a schematic plan view for explaining a manufacturing step of parts of the connector in FIG. 1. FIG. 15 is a front view of FIG. 14.

In FIGS. 1 to 4, a reference numeral 1 designates a wire retaining body formed of a non-conductor of electricity such as a synthetic resin mold. This retaining body 1 includes left and right rising walls 1*a*, 1*b* (see FIG. 14 in which the rising walls 1*a*, 1*b* are located in upper and lower positions) along a longitudinal direction of the seven parallel terminal wires 2 (hereafter simply referred to as "wires 2"), a center retaining portion 1*c* formed integrally with the wires 2 in such a manner as to connect both the rising walls 1*a* and 1*b* at their intermediate portions and in such a manner that the wires 2 are embedded in the center retaining portion 1*c*, and cover walls 1*d*, 1*e* formed integrally with the rising walls 1*a*, 1*b* so as to cover the wires 2 on front and rear sides of the retaining portion 1*c* and at a distance from one faces of the wires 2 in the example in the drawings.

Intermediate portions 2*a* formed in recessed shapes (or protruding shapes) (hereafter referred to as recessed portions 2*a*) in the wires 2 are integrally formed with the center retaining portion 1*c* of the retaining body 1 inside the center retaining portion 1*c*. Front and rear portions (left and right portions in FIG. 1) of the intermediate portions 2*a* are formed into curved portions 2*b*, 2*c* forming low hill shapes (or shallow valley shapes) Tip end portions of the respective curved portions 2*b*, 2*c* are formed into tip end warped portions 2*d*, 2*e* warped in opposite directions to the curved portions 2*b*, 2*c*.

On inner face sides of the center retaining portion 1*c* (upper and lower faces of the opposed retaining bodies 1 in FIG. 1) of the retaining bodies 1, a protruding portion 1*f* and a recessed portion 1*g* to be fitted with each other while working as a key and a keyway when the two opposed inner faces of the retaining bodies 1 are coupled to each other are formed.

Therefore, if the protruding portion if and the recessed portion 1*g* of the two wire retaining bodies 1, 1 are opposed to each other as shown in FIG. 1 and both the retaining bodies 1, 1 are coupled and integrated with each other as shown in FIG. 2, the respective wires 2 facing each other as a result of coupling of the two wire retaining bodies 1, 1 form terminal pinching portions where the tip end warped portions 2*d*, 2*e* of the pairs on the front and rear sides are in contact with each other.

In the example in FIGS. 1 to 4, the center retaining portions 1*c* of the two wire retaining bodies 1, 1 have outer faces 1*h* (where the protruding portion 1*f* and the recessed portion 1*g* are not formed) in slope shapes symmetrical about a point. If the outer faces 1*h* have the same shaper the same parts can be used as the upper and lower two opposed wire retaining bodies 1 in FIGS. 1 while being turned upside down, which is convenient for manufacturing or maintenance.

As shown in FIG. 2, two upper and lower wire retaining bodies I combined into one with their inner faces opposed to each other are inserted in this state into a cylindrical connector casing 3 as shown in FIG. 2 and assembled into a sectional shape shown on the right side in FIG. 3.

The casing 3 has a substantially rectangular cylindrical inner sectional shape and locking step portions 3*a* to be locked to step portions formed of the outer faces 1*h* of the center retaining portions 1*c* of the combined wire retaining bodies 1 are formed at inner intermediate portions. The casing 3 has such hole diameters (internal diameters) on the front and rear sides of the locking step portions 3*a* as to form a right small diameter portion 3*b* and a left large diameter portion 3*c* in the example in FIGS. 2 and 3. A reference numeral 3*d* designates a stopper formed to protrude from an inner wall face of the large diameter portion 3*c* to fix a plug receiving cylinder 4 in a form shown in FIG. 3 in position when the plug receiving cylinder 4 is inserted into the large diameter portion 3*c*.

The plug receiving cylinder 4 includes a pressure contact chip 4*b* for coming in pressure contact with the outer face of the wire retaining body 1 and a stopper hole 4*c* to be engaged with the stopper 3*d* formed in the large diameter portion 3*c* of the casing 3 at an upper portion (see FIG. 4) of a half side of the cylindrical portion 4*a*. On the other hand, the other half side (on a right end side of the cylindrical portion 4*a* in FIG. 4), board pinching legs 4*d* are formed into a substantially bifurcated shape while extending and protruding from the other half side. Two board pinching legs 4*d* are formed on opposite sides (upper and lower sides in FIG. 5) of the cylindrical portion 4*a* and a plurality of terminal pinching portions formed of the plurality of wires 2 are positioned between both the pinching legs 4*d* as shown in FIG. 5.

With the above structure, the one example of the connector Cn of the invention having the vertical sectional (side sectional) shape in FIG; 4 and the cross-sectional (plan sectional) shape in FIG. 5 is formed. This connector Cn is plugged in seven terminals 5*a* to 5*g* formed by printing, for example, and earth terminals 6*a* and 6*b* disposed on opposite sides to pinch these terminals 5*a* to 5*g* on the circuit board Cb shown as an example in FIG. 6. By this plugging-in, connection is conducted by pinching by the terminal pinching portions (the opposed seven tip end portions 2*d*, 2*e* of the respective wires 2) and the board pinching legs 4*d*. A reference numeral 7 designates a notch portion formed in the board Cd and having a recessed shape in a plan view for insertion of the connector Cn. At an inner recessed end of the notch portion 7, the respective terminals 5*a* to 5*g* and 6*a*, 6*b* are formed and disposed.

Next, a manufacturing step of the connector Cn will be described based on FIGS. 1, 14, and 15.

In FIGS. 14 and 15, the seven wires 2 are arranged parallel in a left-right direction in the drawings. In FIGS. 14 and 15, a reference numeral 21 designates a wire forming portion for forming the recessed portions 2*a* to be embedded by integral molding in the center retaining portion 1*c* of the retaining body 1 shown in FIG. 1 and a reference numeral 22 designates a retaining body molding portion for integrally molding the wire retaining body 1 by insert molding with the respective wires 2 at which the recessed portions 2*a* have been molded.

A reference numeral 23 designates a wire working portion and has the following structure. In other words, at the wire retaining body 1 molded with the wires 2 inserted in the wire retaining body 1 by the retaining body molding portion 22, the respective wires 2 are cut to a predetermined length (substantially the equal length to the retaining body 1) by a cut portion. At opposite end portions of the cut respective wires 2, the tip end warped portions 2*d*, 2*e* in arc shapes of small diameters are formed. Then, the whole respective wires 2 with their end portions formed into the warped portions 2*d*, 2*e* are formed into curved portions 2*b*, 2*c* forming low hill shapes (or shallow valley shapes). In FIGS. 14 and 15, reference numerals 21*a*, 21*b* designate molding metal molds of the wire forming portion, 22*a*, 22*b* designate molding metal molds of the retaining body molding portion 22, 23*a*, 23*b* designate metal molds of the cut portion in the wire working portion 23, and 23*c*, 23*d*, and 23*e* are metal molds of a wire forming portion in the wire working portion 23.

Working in the above-described wire working portion 23 will be described.

The wires 2 in which the recessed portions 2*a* have been formed in the forming portion 21 are insert-molded and retained by the wire retaining body 1 and are cut to the predetermined length by the metal molds 23*a*, 23*b*. The wires 2 which have been cut and retained by the wire retaining body 1 are bent in such a manner that the warped portions 2*d*, 2*e* are formed at the opposite ends of the wires 2 by the first upper and lower metal molds 23*c*, 23*d* for bending the opposite end portions of the wires 2 into the warped portions 2*d*, 2*e*.

Next, the plurality of parallel wires 2 formed at tip ends thereof with the warped portions 2*d*, 2*e* and retained by the wire retaining body 1 are bent into the curved portions 2*b*, 2*c* forming low hill shapes (or shallow valley shapes) at intermediate portions between the recessed portions 2*a* and the warped portions 2*d*, 2*e* by the second upper metal mold 23*e* and the first lower metal mold 23*d* while the metal molds 23*c* and 23*d* are moved to retracted positions. Thus, the wire retaining body 1 is formed into a shape of the lower wire retaining body 1 in FIG. 1. The wire retaining body 1 positioned on an upper side of FIG. 1 is also subjected to working of the plurality of parallel wires 2 by the wire working portion 23 with the slope 1*h* of the center retaining portion 1*c* oriented downward similarly to the above example.

The connector Cn of the invention is formed in the shapes shown in FIGS. 4 and 5 through the steps explained above and is plugged in the board Cb (see FIG. 8). The plug Pg of the invention to be connected to the connector Cn of the invention will be described based on FIGS. 9 to 12.

In FIGS. 9 to 12, a reference numeral 8 designates a plug main body formed by plastic molding and a tip end side of a cable 9 having seven conductors 9*a* is integrally molded with the plug main body. The plug main body 8 is provided with a plug-in cylinder portion 10 in an orientation orthogonal to the cable 9. Mounted inside the plug-in cylinder portion 10 is a terminal plate 11 on which seven connecting terminals 12*a* to 12*g* to be connected to the terminal pinching portions of the above-described connector Cn of the invention are formed parallel. Although it is not shown in the drawings, the above seven conductors 9*a* are connected to the respective terminals 12*a* to 12*g* of the terminal plate 11.

Although the plug-in cylinder portion 10 is provided in the orientation orthogonal to the orientation of the cable 9 in the above plug Pg of the invention, it is also possible that the cable 9 and the plug-in cylinder portion 10 are disposed in the same orientation, i.e., in series.

The plug Pg of the invention is plugged in by plugging the plug-in cylinder portion 10 of the plug Pg of the invention in the plug receiving cylinder 4 of the connector Cn of the invention connected without soldering to the respective terminals 5*a* to 5*g* of the board Cb as shown in FIGS. 7 and 8 as an example with the terminal plate 11 of the plug-in cylinder portion 10 in the same orientation (same plane) as the board Cb. By this plugging-in, the respective conductors of the cable 9 of the plug Pg are connected to the respective terminals 5*a* to 5*g* of the board Cb in manners shown in FIGS. 11 and 12 as an example.

FIG. 13 is a perspective view of a state in which the plug Pg of the invention is to be plugged in the connector Cn of the invention plugged in the board Cb. As can be understood from FIG. 13, the plug receiving cylinder 4 of the connector Cn is formed to have an opening in a bilaterally asymmetric shape in FIG. 13 so as to specify a plugged-in orientation of the plug Pg. Naturally, an outer face of the plug-in cylinder portion 10 of the plug Pg is also in the same shape as the asymmetric shape of the receiving cylinder 4.

POSSIBILITIES OF INDUSTRIAL APPLICATION

The present invention is as described above and the connector of the invention is formed as follows in order to connect terminals of the circuit or the like formed by printing on the print board and the input and output terminals of the external device without soldering.

In other words, the connector of the invention comprises a plurality of terminal wires forming gently-sloping hills in a longitudinal direction and having curved front and rear opposite end portions and wire retaining bodies each of which has substantially the same length as the wires to partially cover front half sides and rear half sides of one faces of the wires without contact and to restrain and retain intermediate portions of the wires, wherein the two wire retaining bodies are combined into combined wire retaining bodies in such a manner that the curved opposite end portions of the retained wires face each other to form terminal pinching portions. The combined wire retaining bodies are housed in a cylindrical connector casing having front and rear opposite open ends and the front and rear terminal pinching portions of the retaining bodies face the front and rear open end portions of the connector casing.

On the other hand, the plug of the invention to be connected to the connector of the invention is formed as follows.

In other words, in the plug of the invention, a terminal plate including terminals pinched by and connected to the terminal pinching portions disposed in the plug receiving cylinder of the connector and a plug-in cylinder portion including inside itself the terminal plate fitted into the plug receiving cylinder of the connector are provided to the plug main body and the plurality of conductors of the cable integrated with the plug main body are connected to respective terminals of the terminal plate.

With the above connector and plug of the invention, it is possible to achieve solderless connection between terminals with a simple structure for connection to the terminals arranged in a row and printed on the circuit board.

Especially, the connector of the invention comprises a plurality of terminal wires forming gently-sloping hills in a longitudinal direction and having curved front and rear opposite end portions and wire retaining bodies each of which has substantially the same length as the wires to partially cover front half sides and rear half sides of one faces of the wires without contact and to restrain and retain intermediate portions of the wires, wherein the two wire retaining bodies are combined into combined wire retaining bodies in such a manner that the curved opposite end portions of the retained wires face each other to form terminal pinching portions. The combined wire retaining bodies are housed in a cylindrical connector casing having front and rear opposite open ends and the front and rear terminal pinching portions of the retaining bodies face the front and rear open end portions of the connector casing. Therefore, one wire retaining body can be shared and there are merits such as simple structures of the parts and simple assembly.

What is claimed is:

1. A connector comprising;

a plurality of terminal wires forming gently-sloping hills in a longitudinal direction and having curved front and rear opposite end portions and wire retaining bodies each of which has substantially the same length as the wires to partially cover front half sides and rear half sides of one faces of the wires without contact and to restrain and retain intermediate portions of the wires, wherein the two wire retaining bodies are combined into combined wire retaining bodies in such a manner that the curved opposite end portions of the retained wires face each other to form terminal pinching portions, the combined wire retaining bodies are housed in a cylindrical connector casing having front and rear opposite open ends, and the front and rear terminal pinching portions of the retaining bodies face the front and rear open end portions of the connector casing.

2. The connector according to claim 1, wherein a plug receiving cylinder is housed as a plug plug-in portion in one of the open portions of the connector casing.

3. The plug to be plugged in the connector according to claim 1 or 2, the plug comprising:

a plug main body formed of a non-conductor of electricity such as plastic in a state in which respective conductors of the plurality of cables are led inside;

a plug-in cylinder portion provided to the plug main body and fitted into the plug receiving cylinder according to claim 2; and a terminal plate disposed in the plug-in cylinder portion and pinched by and connected to the terminal pinching portions disposed in the plug receiving cylinder, wherein the plurality of conductors led into the plug main body are connected to respective terminals of the terminal plate.

4. A manufacturing method of a connector including the steps of:

partially covering without contact front half portions and rear half portions of of a plurality of terminal wires arranged parallel with wire retaining bodies each of which has substantially the same length as the wires while leaving one side of the wires open and restraining and retaining intermediate portions of the wires with an intermediate portion of each retaining body;

forming the wires in a restrained and retained state so that the wires form gently-sloping hills in their longitudinal direction and have curved warped front and rear opposite ends;

combining the two wire retaining bodies formed in the above manner into combined retaining bodies in such a manner that the warped portions of the opposite ends of the wires retained by both the retaining bodies face each other to form terminal pinching portions; and housing and fixing the combined retaining bodies into a cylindrical connector casing having front and rear opposite open ends in such a manner that the front and rear terminal pinching portions of the combined retaining body face the front and rear open end portions of the casing.

* * * * *